US006246856B1

(12) United States Patent
Kopp et al.

(10) Patent No.: US 6,246,856 B1
(45) Date of Patent: Jun. 12, 2001

(54) PRINTER AND COPIER DEVICE AND METHOD FOR PERFORMANCE-ADAPTED, MONOCHROME AND/OR CHROMATIC, SINGLE-SIDED OR BOTH-SIDED PRINTING OF A RECORDING MEDIUM

(75) Inventors: Walter Kopp, Taufkirchen; Hans Manzer, Seefeld; Peter Bergmann, Oberding; Otto Ferber, Germering; Josef Schreieder, Malgersdorf, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/380,442

(22) PCT Filed: Nov. 28, 1997

(86) PCT No.: PCT/DE97/02795

§ 371 Date: Sep. 2, 1999

§ 102(e) Date: Sep. 2, 1999

(87) PCT Pub. No.: WO98/39691

PCT Pub. Date: Sep. 11, 1998

(30) Foreign Application Priority Data

Mar. 3, 1997 (DE) ..... 197 08 515

(51) Int. Cl.[7] ..... G03G 15/01; G03G 15/16

(52) U.S. Cl. ..... 399/299; 399/302; 399/306

(58) Field of Search ..... 399/299, 302, 399/306, 307, 308, 309

(56) References Cited

U.S. PATENT DOCUMENTS

| | | | | |
|---|---|---|---|---|
| 4,731,631 | * | 3/1988 | Monkelbaan et al. | 399/306 |
| 4,777,106 | | 10/1988 | Fotland et al. | 430/120 |
| 4,796,048 | * | 1/1989 | Bean | 399/308 |
| 4,992,833 | * | 2/1991 | Derimiggio | 399/308 |
| 5,089,847 | * | 2/1992 | Folkins | 399/6 |
| 5,173,735 | * | 12/1992 | Kusumoto | 399/302 |
| 5,640,659 | * | 6/1997 | Thompson et al. | 399/307 |
| 5,742,888 | * | 4/1998 | Fuchiwaki et al. | 399/308 |
| 5,805,967 | * | 9/1998 | De Bock et al. | 399/302 X |

FOREIGN PATENT DOCUMENTS

| | | |
|---|---|---|
| 196 18 324 A1 | 11/1996 | (DE) . |
| 0 320 985 | 6/1989 | (EP) . |
| 0 478 820 A1 | 4/1992 | (EP) . |
| 0 629 931 A1 | 12/1994 | (EP) . |
| 0 775 948 A1 | 5/1997 | (EP) . |
| 2 190 209 | 11/1987 | (GB) . |

* cited by examiner

*Primary Examiner*—Fred L Braun
(74) *Attorney, Agent, or Firm*—Schiff Hardin & Waite

(57) ABSTRACT

A printer or copier and method generates toner images for transfer onto a recording medium. A latent charge image is generated on a photoconductor and is developed by the application of toner by at least one developer station to generate the toner image for transfer to the recording medium. A plurality of the developer stations are provided along the photoconductor to develop the images in color using a color separation method. A transfer band collects the color separations on top of one another to generate the overall toner image which is transferred to the recording medium. Multiple modules, each with developer stations, a photoconductor and a transfer band may be provided for one sided or two sided printing.

19 Claims, 16 Drawing Sheets

PRINTER AND COPIER DEVICE AND METHOD FOR PERFORMANCE-ADAPTED, MONOCHROME AND/OR CHROMATIC, SINGLE-SIDED OR BOTH-SIDED PRINTING OF A RECORDING MEDIUM

BACKGROUND OF THE INVENTION

1. Field of the Invention

The present invention is directed to a printer or copier device for performance-adapted, monochrome and/or chromatic, single-sided or both-sided printing of a recording medium.

2. Description of the Related Art

In electrophotographic color printers having high printing quality as disclosed, for example, by European Patent Document EP-A1-0 629 931, there is the problem that the same length of time is always required for producing a printed page given both a monochrome printing mode as well as given a chromatic printing mode. This means that was is referred to as the performance, i.e. the speed efficiency of the printer, is based on full color printing. When such a printer is utilized in a mixed printing operation, then it is usually the monochrome printing that occurs. Given electrophotographic high-performance printing with 200 pages/minute or higher, the print jobs to be processed contain a majority of monochrome printouts. Only a small portion of the print job is chromatic. Thus, for example, it can occur that a plurality of black-and-white successive pages are printed within a print job and that a full color image must then be printed, for example when producing a brochure. When the standard color printing devices are utilized for production of such a brochure, then they are relatively slow, since, as already stated, the printing performance is based on the color printing performance. Such color printer devices are also complicated and cost-intensive and inefficiently utilized for mixed operation.

Color printer devices with which single-color or two-color can be printed at high speed are disclosed, for example, by U.S. Pat. No. 5,526,107. In the known color printer device, continuous form paper is supplied to a transfer printing location of a photoconductive cylinder that comprises respective electrophotographic units for producing differently colored toner images on two surfaces. The continuous form paper is printed with a first color on the front side at the transfer printing location, the continuous form paper is subsequently deflected and supplied to a printing location at the same photoconductive cylinder lying opposite the transfer printing location and is printed on the backside of the paper.

German Patent Document A-176 18324 also discloses that color printing be performed in that a plurality of developer stations allocated to the individual color separations of the color image are arranged along a photoconductor. The developer stations can be individually mechanically activated, namely in that they are brought into mechanical contact with the photoconductor band. For producing color printing, individual color separations are generated on the photoconductor band and are then transferred onto a collector in the form of an intermediate transfer drum. This intermediate transfer drum then transfers the full color image that has arisen by the superimposition onto a single page.

It is also known to employ a transfer band instead of the transfer cylinder, as disclosed by European Patent Document A2-0 320 995.

What all known color printer devices have in common is that their performance is based on the color printing speed and that the printer devices are therefore uneconomical to utilize for mixed operation.

SUMMARY OF THE INVENTION

An object of the present invention is to offer a multi-color printer or copier device with high printing performance that is especially suited for mixed operation and whose performance is based on the maximum printing output in monochrome operation.

This object is achieved by a printer or copier device for performance-adapted, monochrome and/or chromatic single-sided or both-sided printing of a recording medium, whereby the device comprises:

at least one electrophotography module for generating toner images on a continuous photoconductor with the assistance of a plurality of developer stations that are arranged along the surface of the photoconductor and that are individually switchable, each of the developer stations being respectively allocated to a single color separation toner image;

at least one transfer module with an endless transfer band that comprises a transfer region for accepting toner images from the electrophotography module and a controllable transfer printing region for the transfer printing of toner images onto the recording medium, whereby, in a transfer printing condition of the transfer module, the transfer band contacts the recording medium and, in a collecting condition of the transfer module, the transfer band is spaced from the recording medium;

a transport channel comprising a controllable transfer means for the recording medium and having electrophotography and transfer modules arranged at one side or both sides of the transport channel;

a control means coupled to the electrophotography module, to the transfer module and to the transport means that controls the electrophotography module, transfer module and transport means such that, for printing a recording medium moved through the transfer printing region in a start-stop mode in a first operating condition of the apparatus, the color separation toner images, in the collecting condition of the transfer module, are serially transferred from the electrophotography module onto the transfer band and an exactly registered collective image is thus produced on the transfer band, this then being transferred in the transfer printing state of the transfer module onto the recording medium, and for printing a recording medium moved continuously through the transfer printing region in a second operating condition of the apparatus in the transfer printing status of the transfer module, the toner images are directly transferred from the electrophotography module onto the transfer band and are transferred farther therefrom onto the recording medium without collecting.

Advantageous embodiments of the invention are provided by a printer or copier device having at least one electrophotography module allocated to the front side of the recording medium with an appertaining transfer module and at least one electrophotography module allocated to the back side of the recording medium with an appertaining transfer module, whereby the transfer modules are arranged at both sides of the transport channel. The transfer modules are either arranged lying opposite one another in the transfer printing region, or the transfer modules have their transfer printing region arranged offset relative to one another along the transport channel.

The printer or copier device may have at least one fixing module following the transfer printing region in the conveying direction of the recording medium and having a thermal fixing means arranged therein. The fixing module for thermal fixing of the image follows every transfer printing region of the transfer modules arranged offset relative to one another as viewed in the conveying direction of the recording medium. The thermal fixing means may be an infrared fixing means that works in a non-contacting fashion with the recording medium. In particular, the thermal fixing means for fixing single sheets may include a conveyor belt that accepts the single sheet with its side that has not yet been tonered or already fixed and an infrared means lying opposite the conveyor belt for fixing the loose toner images.

The transport means includes motor-driven conveyor rollers for the recording medium. A delivery module is provided for the recording medium which serves as a web storing means in the fashion of a loop-forming means. A post-processing module may be provided following the fixing module or modules and having a separating means arranged therein.

In a preferred embodiment, the developer stations are individually replaceable in the printer or copier. As an improved development, the electrophotography module may include a plurality of image-generating devices each with a character generator and at least one developer station. The transfer band may be a cold transfer band, whereby the transfer of the toner images ensues on the basis of electrostatic forces, or the transfer band may be a heat transfer band with an appertaining heating means, whereby the toner image is simultaneously transfer printed and fixed in the transfer printing region between the transfer band and the recording medium.

The printer or copier device may also be configured to process single sheets, whereby an electrophotography and transfer module is arranged at only one side of the transport channel, and whereby a turn-over means with appertaining return channel is arranged downstream of the fixing module, this discharging into the transport channel upstream of the transfer printing station.

The developer stations may be fluidizing developer stations. The developer stations are arranged along a path of the photoconductor proceeding in an angular range of 35° through 50° relative to the perpendicular.

The present invention also provides a method for performance-adapted monochrome and/or chromatic, single-sided or both-sided printing of a recording medium with a printer or copier device, using a device including: at least one electrophotography module for generating toner images on a continuous photoconductor with the assistance of a plurality of developer stations arranged along the surface of the photoconductor and individually switchable that are respectively allocated to a single color separation toner image; at least one transfer module with an endless transfer band that comprises a transfer region for accepting toner images from the electrophotography module and a controllable transfer printing region for the transfer printing of toner images onto the recording medium, whereby, in a transfer printing condition of the transfer module, the transfer band contacts the recording medium and, in a collecting condition of the transfer module, the transfer band is distanced from the recording medium; a transport channel comprising a controllable transport means for the recording medium and having electrophotography and transfer module arranged at one side or both sides of the transport channel; the method including the following steps:

printing a recording medium moved through the transfer printing region in a start-stop mode in a first operating condition of the apparatus by serial transfer from the electrophotography module, superimposed deposit as a collective image on the transfer band and transfer printing status of the collective image onto the recording medium, and printing a recording medium moved continuously through the transfer printing region in a second operating condition of the apparatus by direct transfer of a toner image from the electrophotography module onto the transfer band and farther therefrom onto the recording medium without collecting.

BRIEF DESCRIPTION OF THE DRAWING

Embodiments of the invention are shown in the drawings and are described in greater detail below by way of example.

DETAILED DESCRIPTION OF THE PREFERRED EMBODIMENTS

Figure 1:
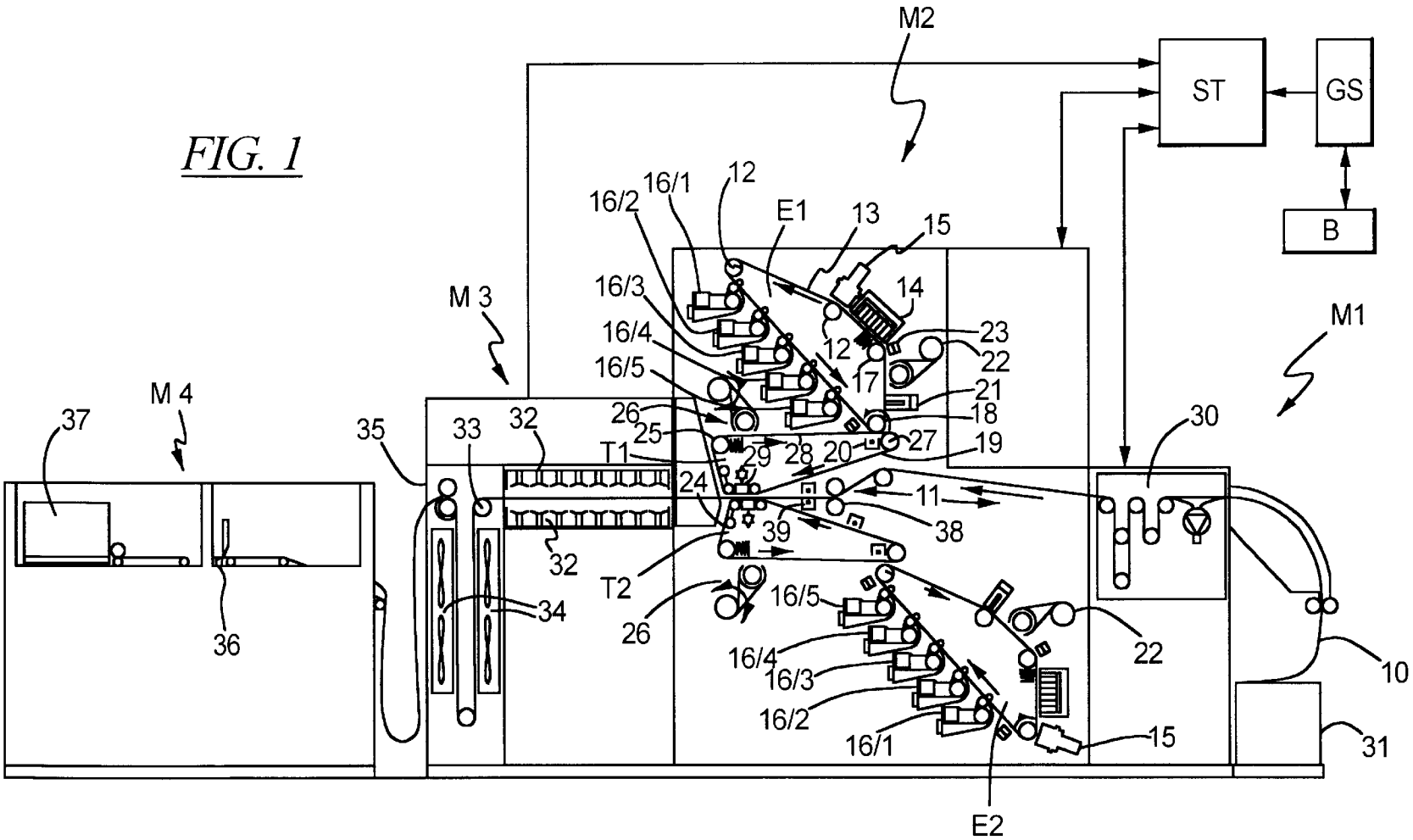
FIG. 1 is a schematic sectional view of an electrophotographic printer device for performance-adapted, monochrome and/or chromatic, single-sided or both-sided printing of a web-shaped recording medium.

The printer device for performance-adapted, monochrome and/or chromatic, single-sided or both-sided printing of a web-shaped recording medium shown in FIG. 1 is modularly constructed and fundamentally comprises a delivery module M1, a printer module M2, a fixing module M3 and a post-processing module M4. The delivery module M1 contains the elements for delivering, for example, continuous form paper taken from a stacker to the printer module M2. The printer module M2 contains the actual electrophotographic printer units that print the recording medium that is then fixed in the fixing module M3 and cut or, respectively, stacked in the post-processing module M4.

The modules in detail:

The printer module contains the units required for printing a web-shaped recording medium 10 with toner images, these being arranged at both sides of a transfer channel 11 for the recording medium 10. These units are essentially composed of two differently configurable electrophotography modules E1 and E2 with appertaining transfer modules T1 and T2. The modules E1 and T1 are thereby allocated to the front side of the recording medium 10 and the modules E2 and T2 are allocated to the back side. The identically constructed electrophotography modules E1 and E2 contain a seamless photoconductor band 13 formed of, for example, an organic photoconductor (OPC) supplied via deflection rollers 12 and electromotively driven in an arrow direction. The units for the electrophotographic process are arranged along the light-sensitive side of the photoconductor 13. They serve the purpose of generating toner images that are allocated to the individual color separations on the photoconductor. To this end, the photoconductor which is moved in an arrow direction is first charged to a voltage of approximately 1000 V with the assistance of a charging means 14, and then is discharged to approximately 50 volts in a character-dependent fashion with the assistance of a character generator 15 composed of a LED comb. The latent charge image that is generated in this way and situated on the photoconductor is then inked with toner with the assistance of developer stations 16/1 through 16/5, and, with the assistance of the intermediate illumination means 17, the image is subsequently loosened and transferred onto a transfer band 19 of the transfer band module T1 in a transfer printing region 18 with the assistance of a transfer corona means 20. Subsequently, the entire photoconductor band is discharged over its entire width with the assistance of the discharging corona means 21 and is cleaned of adhering toner dust via a cleaning means 22 with cleaning brush. A following intermediate illumination means 23 sees to it corresponding charge-related conditioning of the photoconductor band that, as already described, is then uniformly charged with the assistance of the charging means 14.

Toner images allocated to the individual color separations of the color image to be produced are generated with the electrophotography module E1 or, respectively, E2. To this end, the developer stations 16/1 through 16/5 are fashioned so as to be switchable. They contain the respective toner allocated to an individual color separation. For example, the developer station 16/1 contains black toner, the developer station 16/2 contains toner having the color yellow, the developer station 16/3 contains toner having the color magenta, the developer station 16/4 contains toner having the color cyan and, for example, the developer station 16/5 has blue toner or toner of a special color. Both single-component as well as two-component toner developer stations can be employed as the developer stations. Preferably, however, single-component toner developer stations are utilized, these working with fluidizing toner as disclosed, for example, by U.S. Pat. No. 4,777,106 (Fotland). The subject matter of this United States Letters Patent is incorporated herein by references as a component part of the present disclosure. In order to achieve the switchability of the developer stations, i.e. in order to be able to individually actuate each individual developer station, these, given the employment of fluidizing toner, can, for example, be fashioned in conformity with the earlier German Patent Application having Serial No. 19652866.6. The switching of the developer station thereby ensues by changing the electrical bias of the transfer drum or, respectively, by modifying the electrical bias of the applicator drum. It is also known to switch the developer stations in that they are mechanically shifted and are thereby brought into contact with the photoconductor band 13. Such a principle is disclosed, for example, by German Patent Document A1-19618324.

During operation of the printer means, it is always respectively one toner image that is generated by a single developer station via the developer stations 16/1 through 16/5, this toner image being allocated to a single color separation. This toner image is then electrostatically transferred onto the transfer band 19 of the transfer module T1 via the transfer printing means 18 in combination with the transfer corona means 20. The transfer module T1 contains the transfer band 19 that is composed of a rubber-like substance and that is conducted around a plurality of deflection devices and motor-driven. The transfer band 19 is fashioned similar to the photoconductor band 13, being endless and without a seam. It is moved in an arrow direction and, proceeding from the transfer region with the drum 18 and the transfer corona means 20, is moved to a transfer printing station 24 and is moved therefrom around a deflection roller 25 to a cleaning station 26 and is moved in turn from the latter to the transfer region 18 and 20 with the deflection drum 27 arranged thereat.

The transfer band 19 in the transfer module T1 functions as a collector for the individual toner images allocated to the color separations, these being transferred onto the transfer band 19 via the transfer means 18 and 20. The individual toner images are thereby arranged on top of one another, so that an overall toner image corresponding to the color image arises. In order to be able to produce the overall color toner image and to then transfer it onto the front side of the recording medium 10, the transfer module T1 contains a switchable transfer printing station 24. This, corresponding to the illustration of FIG. 1, can contain a plurality of mechanically displaceable transfer printing drums 28 with appertaining transfer corona means 29. In the operating mode "collect", the transfer printing drums 28 and the transfer printing corona 29 are shifted upward in conformity with the arrow direction, so that the transfer band is spaced from the recording medium 10. In this condition, the individual toner images are taken from the electrophotography module E1 and are superimposed on the transfer band 19. The cleaning station 26 is deactivated by being pivoted out. The recording medium 10 is at rest in the region of the transfer printing station 24 in this operating condition.

The electrophotography module E2 and the transfer module T2 for the backside of the recording medium 10 are constructed like the modules E1 and T1. Here, too, a collective color toner image for the backside is generated on the transfer band T2, whereby the corresponding transfer printing station 24 is also swivelled out in the operating condition "collect".

For simultaneously printing the front side and back side of the recording medium 10, the transfer bands 19 of the transfer modules T1 and T2 are simultaneously brought into contact with the recording medium 10 in the region of their transfer printing stations 24 and the recording medium 10 is thereby moved. At the same time, the cleaning stations 26 of the transfer modules T1 and T2 are pivoted in and activated. After transfer of the two toner images onto the front side or, respectively, onto the back side of the recording medium 10, toner image residues adhering to the transfer bands 19 are removed via the cleaning stations 26. This is then in turn followed by a collecting cycle for generating new toner images, whereby the transfer bands 19 are pivoted out and the recording medium 10 is at a standstill. The transfer of the toner images from the transfer modules T1 and T2 onto the recording medium 10 thus ensues in start-stop operation of the recording medium.

The recording medium 10 is moved in the paper transport path 11 with the assistance of motor-driven conveyor rollers 38. In the region between the conveyor rollers 38 and the transfer printing stations 24, charge or, respectively, corona devices 39 for paper conditioning can be provided so that, for example, a uniform charge for before the transfer printing.

So that the recording medium 10 which is composed of paper does not tear given this start-stop operation and can also be continuously supplied, the delivery module M1 contains a loop-forming element 30. This loop-forming element 30 which is functioning as a band store buffers the recording medium 10 that is continuously taken from a stack means 31.

After the transfer of the two chromatic toner images onto the recording medium 10 in the region of the transfer printing stations 24, these must still be fixed to the recording medium. The fixing module M3 serves this purpose. It contains an upper and lower row of infrared radiators 32 between which the paper transport channel or the recording medium 10 proceeds. Since a loose toner image is situated both on the front side as well as on the back side of the recording medium, the recording medium 10 in the region of the infrared radiators 32 is guided freely in a non-contacting fashion via a deflection roller 33 arranged at the output side. The fixing ensues via the heat of the infrared radiators 32. A cooling of the recording medium 10 ensues in a cooling path following the infrared radiators 32 with cooling elements 34 and deflection rollers 35, as is a smoothing, for example via appropriate decurler devices. Blower-driven air chambers can serve as the cooling elements 34.

After fixing and cooling the two toner images, a corresponding post-processing of the recording medium 10 ensues within the framework of the post-processing module M4 that, for example, can contain a cutter means 36 with stacking means 37.

The printer was described above with reference to the printing mode providing of duplex and color printing. In this operating condition, color images are printed on both sides on the recording medium 10 which is operated in a start-stop transport mode. This mode is the slowest of the printing modes. In the framework of a job to be processed, printing is carried out in a single-color in simplex or duplex mode for the majority of the time. In this operating condition, the recording medium 10 is continuously moved and the transfer stations T1 and T2 are in continuous contact with the recording medium. Only one developer station of the developer module E1 or, respectively, E2 is activated, this respectively producing a single-color toner image that is transferred directly onto the transfer bands 19 and from the latter onto the recording medium 10. The transfer bands 19 thereby work as direct transfer elements without performing collecting functions; the cleaning stations 26 are therefore continuously activated.

The printer device is thus constructed to adopt its performance to the job at hand. This means it is adapted to the most frequently occurring, monochrome printing and is especially fast as a result of the continuous operation. When color printing is desired, a switch is made the start-stop operating mode and the required time expenditure is dependent on the number of colors contained in the color image and, thus, is dependent on the number of activated developer stations 16/1 through 16/5. When, for example, only two colors are printed, for example black with red in the spot color method, then only two transfer processes with collecting processes are required in the developer module E1 and in the transfer module T1 for the presentation of the collective toner image. The analogous situation applies given three colors, etc.

Various other operating conditions can be produced in the printer dependent on the activation of the various modules. Thus, for example, a chromatic simplex mode can be achieved by activating the developer module and transfer module at only the one corresponding, desired side of the recording medium or, on the other hand, a mixed operation can be achieved, whereby, for example, multicolor images are printed on the front side and monochrome images are printed on the back side of the recording medium. In this case, the transfer module serving for monochrome image generation can remain permanently swivelled in.

A microprocessor-controlled control means ST coupled to the device controller GS of the printer serves to realize these various operating conditions, this control means ST being in communication with the delivery module M1, printer module M2 and fixing module M3 or, respectively, post-processing module M4 components to be controlled and regulated. Within the modules, the control means St is coupled to the individual units, thus, for example, to the electrophotography modules E1 and E2 and to the transfer modules T1 and T2. A control panel B via which the various operating conditions can be input is connected to the device controller GS or, respectively, to the control ST, which can be a component part of the device controller. The control panel B can contain a touch screen picture screen or, respectively, a PC with a coupled keyboard. The control itself can be conventionally constructed.

The subject matter of the invention can then be varied in conformity with the desired purpose. This is particularly easily possible because the device is modularly constructed and the individual units are also fashioned as individual modules that can be exchanged and added.

Figure 2:
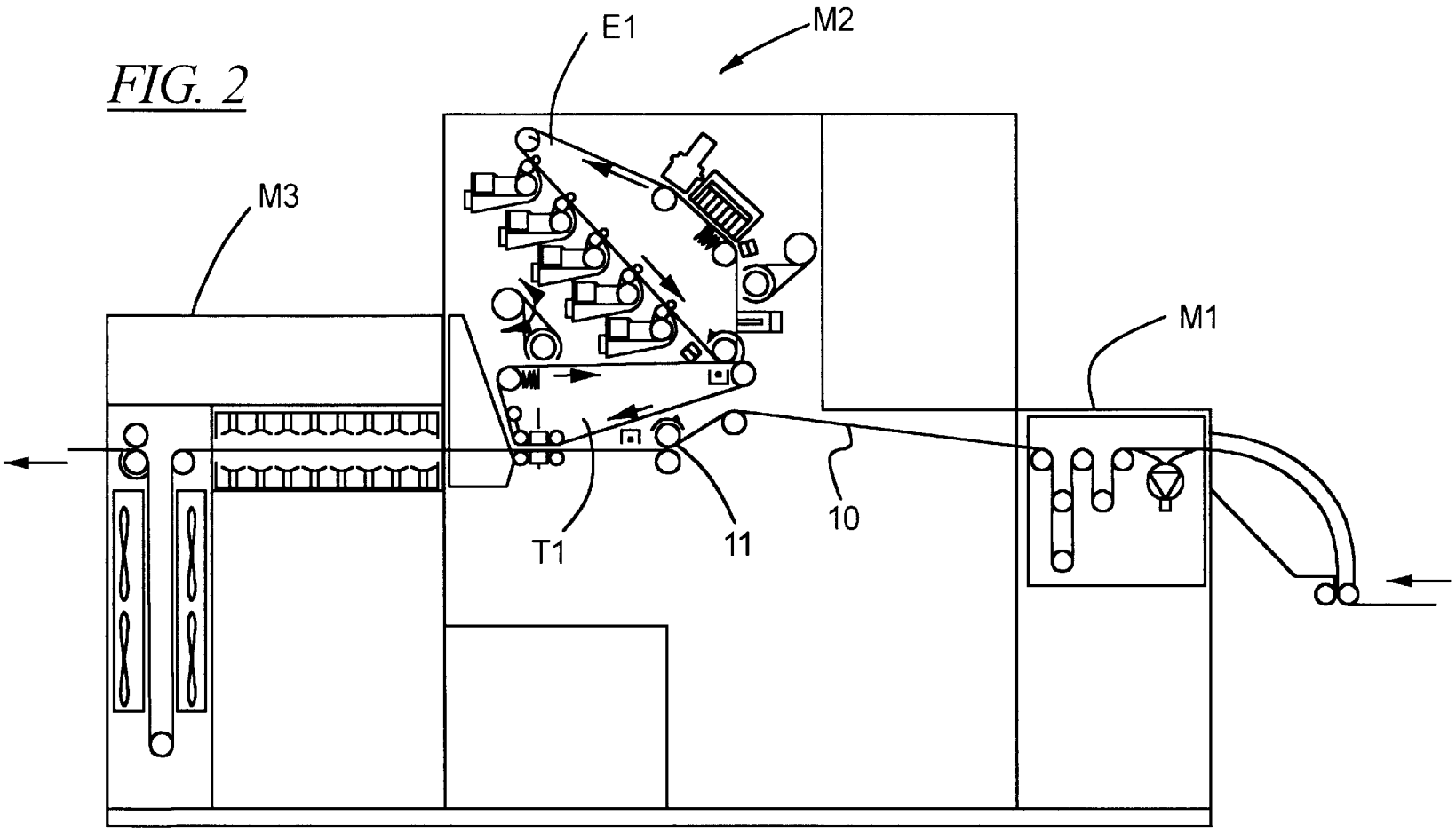
FIG. 2 is a schematic sectional view of a printer device according to FIG. 1 that is designed only for simplex mode.

Given the embodiment according to FIG. 2, an electrophotography module E1 and a transfer module T1 are arranged at only one side of the transport channel 11. In this slimmed-down form, the device is thus fashioned to be adapted to the needed performance for the simplex mode. The device can be operated in a full-color mode or monochromatically.

Figure 3:
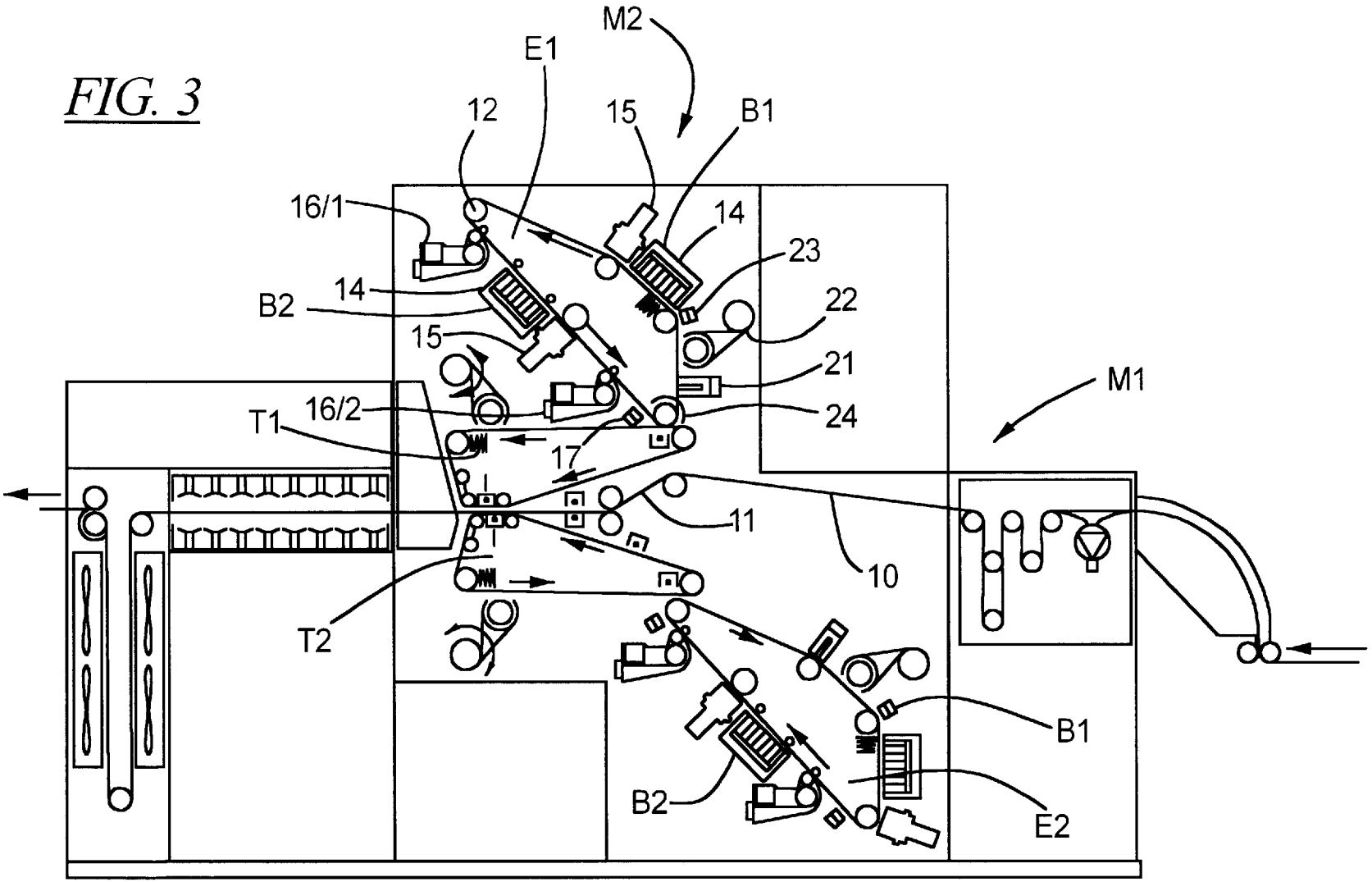
FIG. 3 is a schematic sectional view of a printer device designed for duplex mode, whereby the electrophotography modules comprise two independent, image-generating means, and that is designed for continuous two-color printing operations.

Given the embodiment according to FIG. 3, the electrophotography modules E1 and E2 contain two devices B1 and B2 that generate images and work independently of one another. The first image-generating device B1 contains a character generator 15, a charging means 14, an intermediate exposure means 23, a cleaning device 22, a discharge corona means 21 and a developer station 16/1. The second image-generating means B2 is constructed to be analogous thereto with a charging means 14, character generator 15, a developing station 16/2 and an intermediate exposure means 17. The developer station 16/1 can be allocated to a first color, for example black, and the developer station 16/2 can be allocated to a second color, for example blue or some other color. It is thus possible to first produce a first toner image with the color black with the electrophotography modules E1 or E2 and to superimpose this black toner image with a toner image having the additional color with the second image-generating means B2. The toner image which is super imposed in this way a so-called (spot color toner image) is then transferred onto the transfer modules T1 and T2 and is immediately transferred therefrom onto the recording medium 10. It is thus possible to apply two-color toner images on both sides on the continuously moving recording medium. When only the image-generating means B1 or B2 is activated, continuous printing is carried out in a monochrome fashion. In both operating modes, the transfer modules T1 and T2 serve only for the transfer without the operating mode "collect" being necessary. However, it can also be imagined that both image-generating means B1 and B2 be actuated in alternation and that the transfer modules T1 and T2 be operated in the operating mode "collect", as initially set forth.

Figure 4:
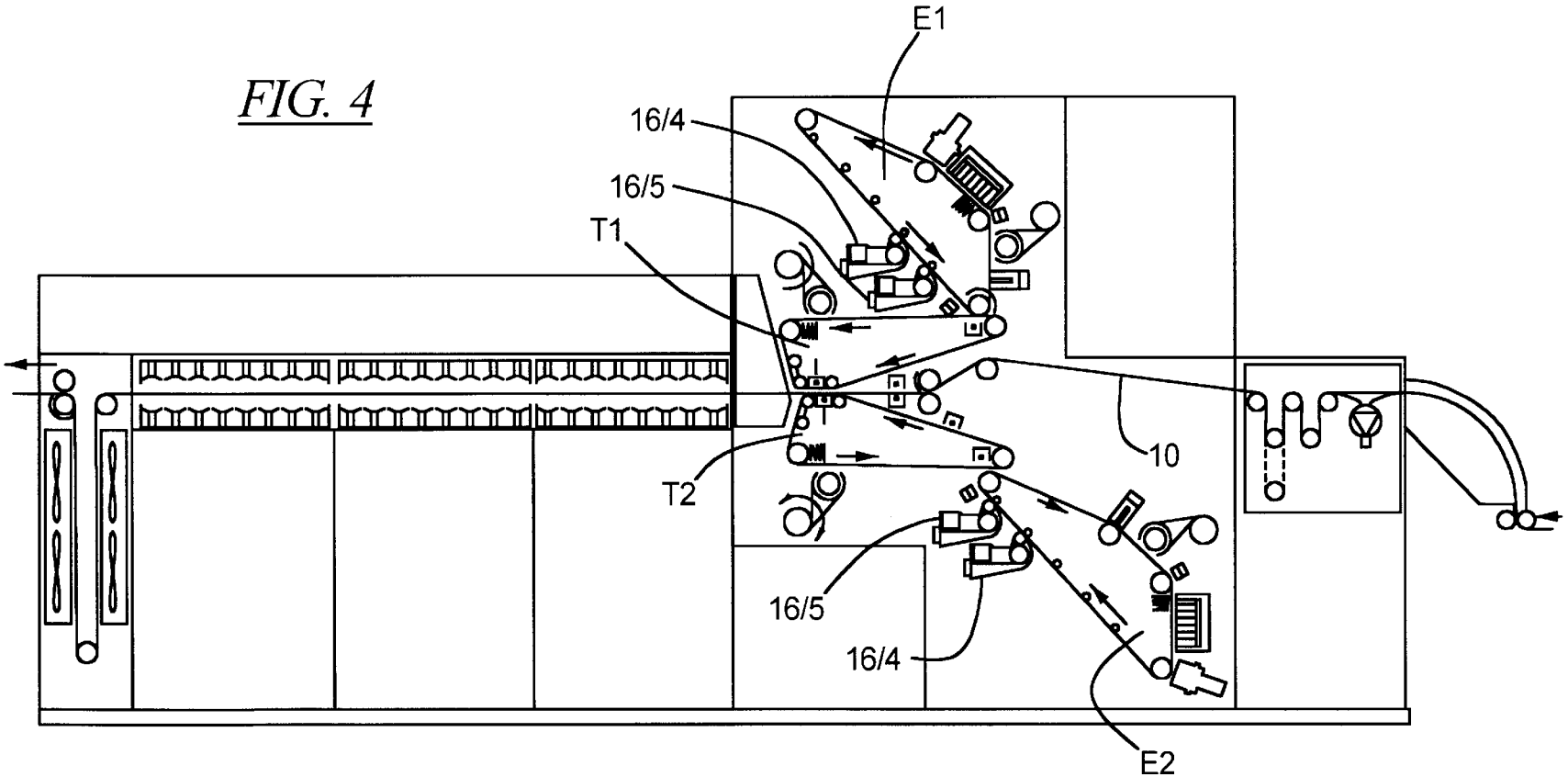
FIG. 4 is a schematic sectional view of a printer device according to FIG. 1 that comprises two developer stations in the electrophotography module.

Another possibility for generating spot color in a duplex operation is shown in the embodiment according to FIG. 4. The two electrophotography modules E1 and E2 thereby contain only two developer stations 16/4 and 16/5 to which respectively one color, for example the color black or the color red in the other developer station is allocated. The recording medium 10 is operated in a start-stop mode, and the transfer modules T1 and T2 work in the operating mode "collect". Here, too, it is possible to activate only one of the developer stations 16/4 or, respectively, 16/5 in a monochrome operation and to then continuously print the recording medium 10 in performance adapted mode.

Figure 5:
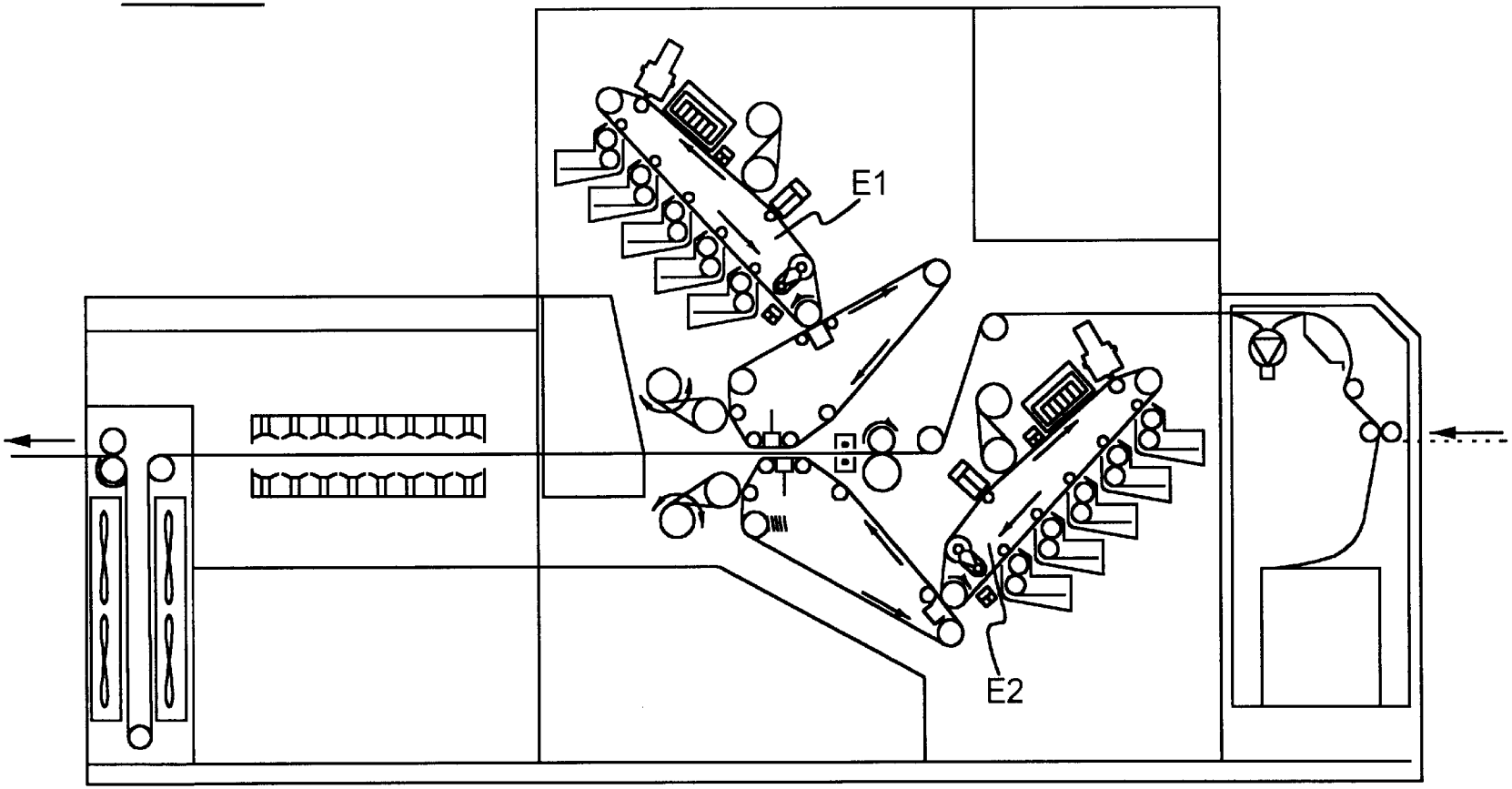
FIG. 5 is a schematic sectional view of a printer device according to FIG. 1 having a specific arrangement of the electrophotography modules.

The embodiment according to FIG. 5 corresponds in terms of its fundamental structure to the embodiment of FIG. 1 and, differing from FIG. 1, the electrophotography modules E1 and E2 are arranged in a space-saving fashion, namely at an angle of approximately 45° relative to the perpendicular.

Figure 6:
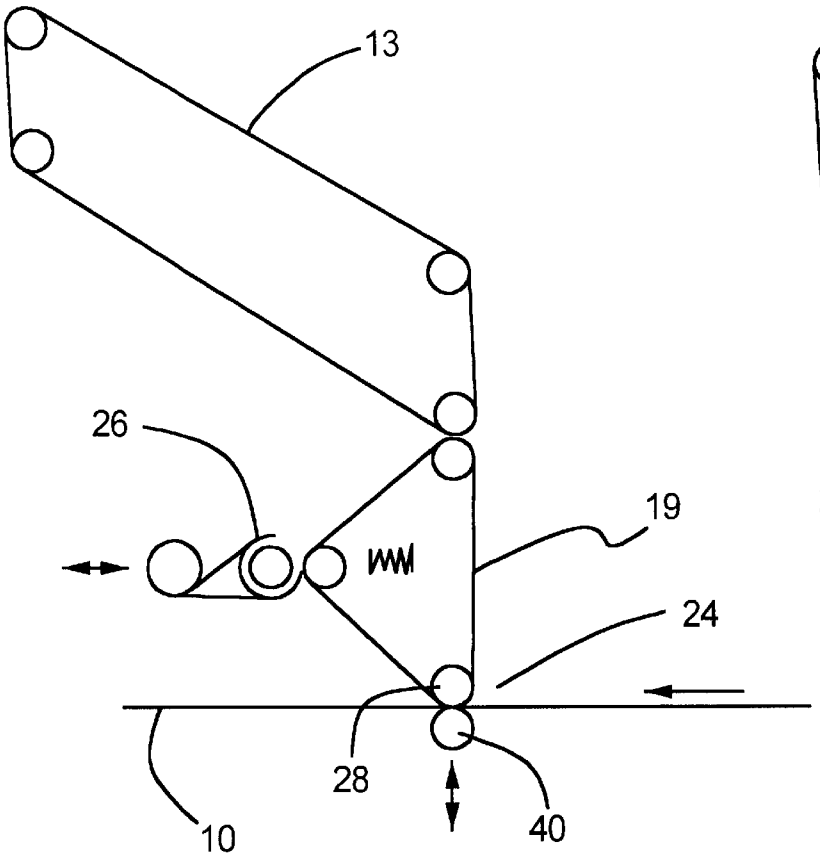
FIG. 6 is a schematic illustration of the transfer module with a constantly circulating transfer band and switchable cleaning stations.

FIG. 6 shows a schematic illustration of the transfer module T1 with a constantly circulating transfer band and a switchable cleaning station. What is referred to as a cold transfer band serves as the transfer band 19. The cleaning station 26 can be mechanically pivoted in and out and can thus be activated. The transfer printing station 24 which is composed of the transfer printing drum 28 and a cooperating drum 40 is likewise switchable. The recording medium 10 is brought into touching contact with the transfer band 12 via the cooperating drum 40. The means is thus particularly suited for the simplex operation shown in FIG. 2.

Figure 7:
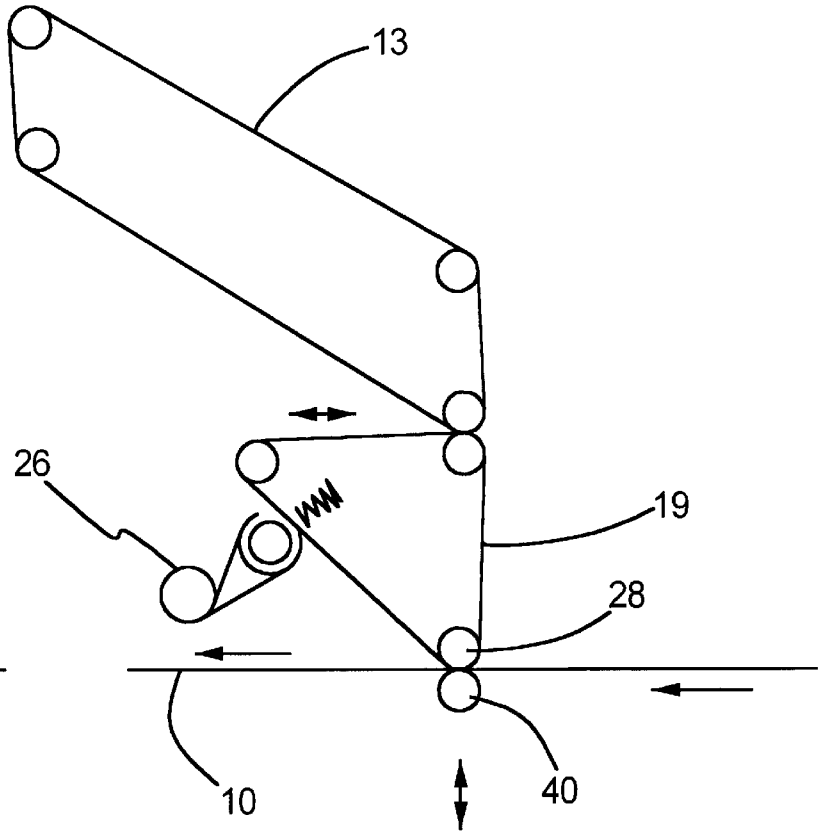
FIG. 7 is a schematic illustration of a transfer module that is operated in repetition mode.

A further fundamental possibility of producing the collecting mode in the transfer module T1 is shown in FIG. 7. The cleaning station 26 is thereby constantly pivoted in against the transfer band 19, and the transfer band 19 and, thus, the transfer module T1 is operated in a retarding mode. This means that the cooperating drum 40 is pivoted out in the retarding collecting mode and, thus, that the recording medium 10 is not in contact with the transfer band 19. The first separation toner image is transferred onto the transfer band 19 via the electrophotography module E1. The transfer band 19 is subsequently mechanically separated from the electrophotography module E1 and is moved back in conformity with the length of the toner image. For the second superimposed toner image, the transfer band 19 is pivoted back in against the photoconductor 13, and, given opposite direction of movement, a further color separation toner image is superimposed on the toner image is situated on the transfer band 19, etc. When all color separations are superimposed, the collective color toner image is transferred onto the recording medium.

In the illustrated exemplary embodiments of FIGS. 6 and 7, the transfer printing stations 24 are switchable with the assistance of pivotable cooperating drums 40. However, it is also possible to enable the switching by corresponding displacement of the transfer printing drums 28 in order to thus enable an operating mode as shown in FIG. 1.

Figure 8:
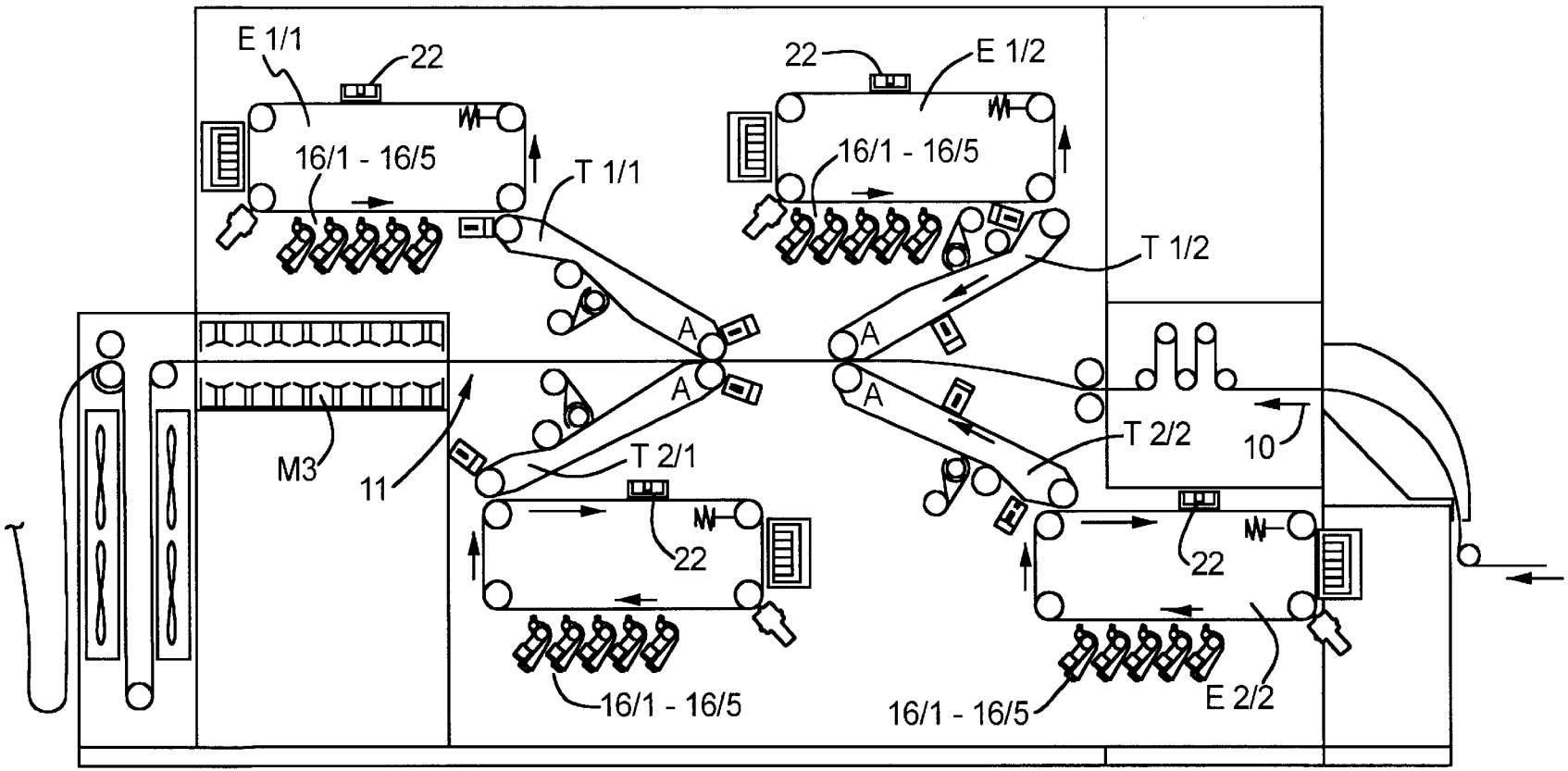
FIG. 8 is a schematic sectional view of an embodiment of the printer device wherein respectively two electrophotography and transfer modules are arranged at both sides of the transport channel for the recording medium.

The embodiment according to FIG. 8 comprises respectively two electrophotography modules E1/1 and E1/2 or, respectively, E2/1 and E2/2 as well as corresponding transfer modules T1/1 and T1/2 or, respectively, T2/1 and T2/2 at both sides of the transport channel 11. As a result of this arrangement of respectively two modules at each side of the transport channel, these working independently of one another, the printing speed can be doubled, particularly given full-color operation.

Moreover, it is possible to actuate the electrophotography or, respectively, transfer modules in alternation in order, for example, to thus also increase the printing speed in that, for example, the transfer module T1/1 is in a collecting condition while the transfer module T1/2 transfer prints or vice versa.

Figure 9:
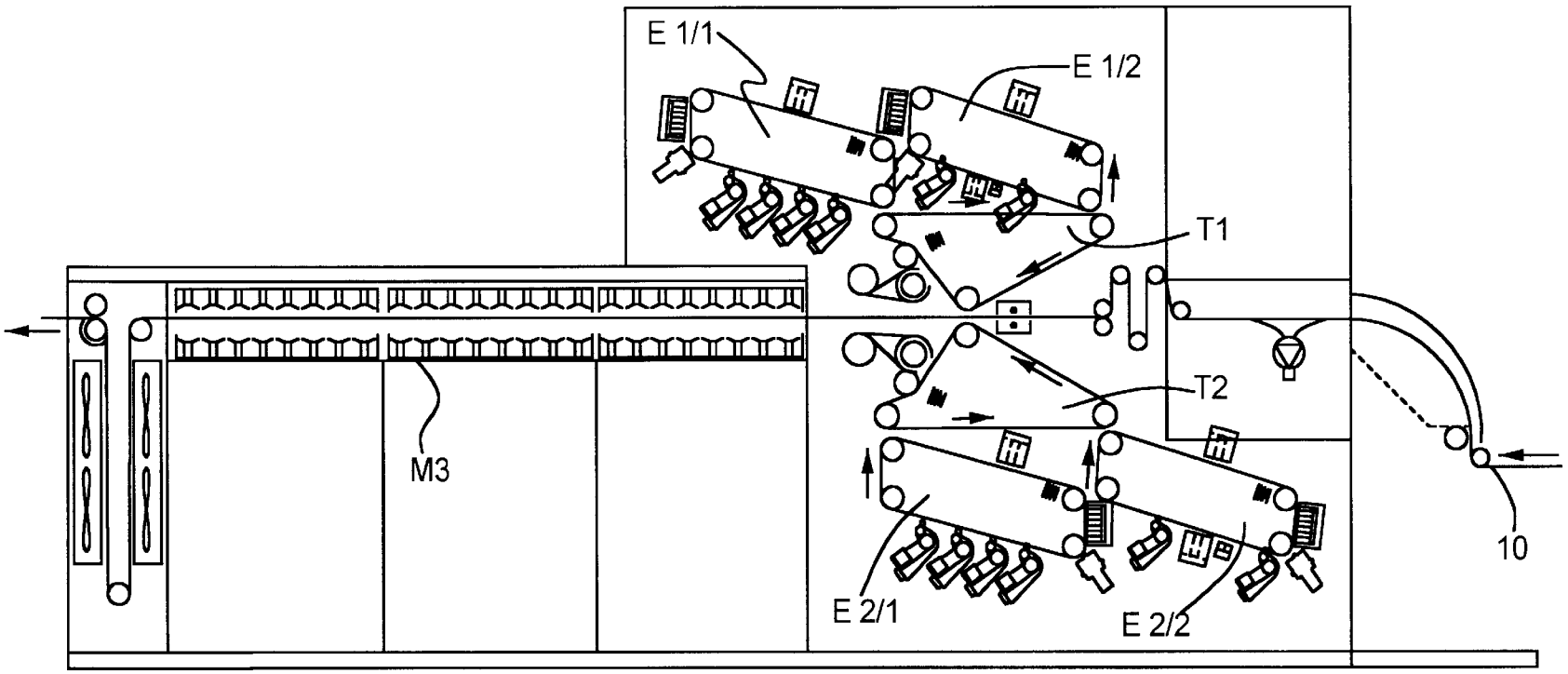
FIG. 9 is a schematic sectional view of an embodiment of a printer device according to FIG. 8 wherein the two transfer modules are respectively combined to form one transfer module.

When respectively only one transfer module T1 or, T2 is employed at each side of the transport channel 11, one arrives at the embodiment corresponding to FIG. 9, whereby two electrophotography modules E1/1, E1/2 or, respectively, E2/1, E2/2 are arranged at each side, these respectively acting on one transfer module T1 or T2. It is thus possible to significantly shorten the collecting event in that the two electrophotography modules simultaneously transfer corresponding color separation images onto the transfer module.

Figure 11:
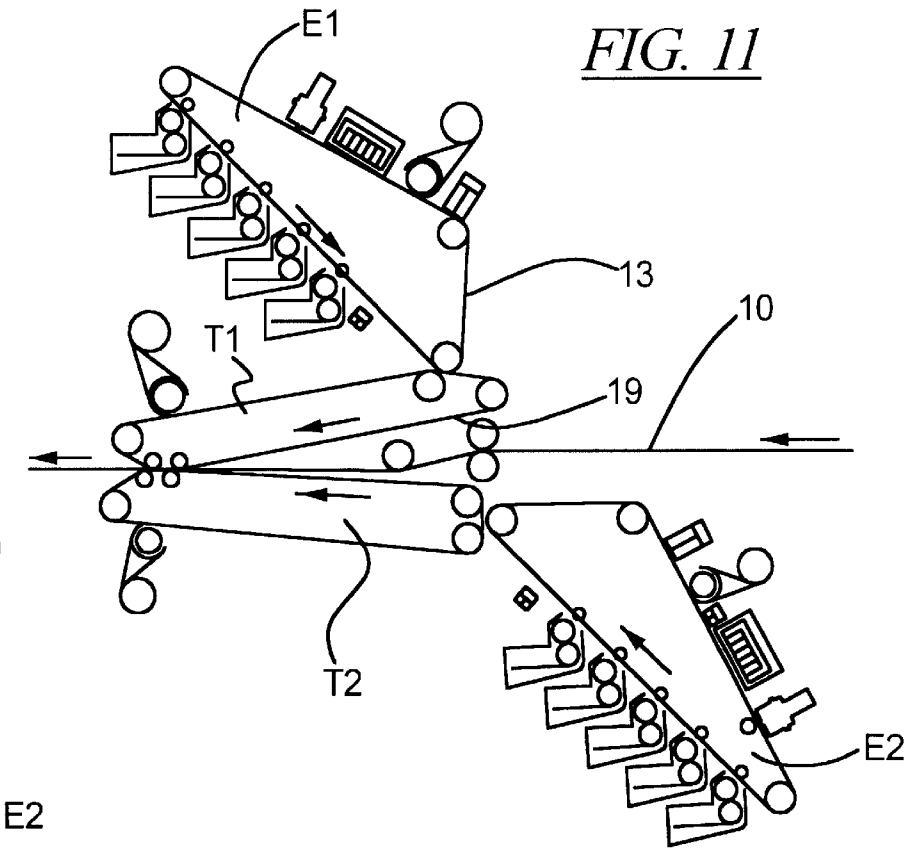
FIGS. 10 through 14 are schematic sectional views of printer devices according to FIG. 1 with differing arrangement and differing embodiments of electrophotography and transfer modules.
Figure 10:
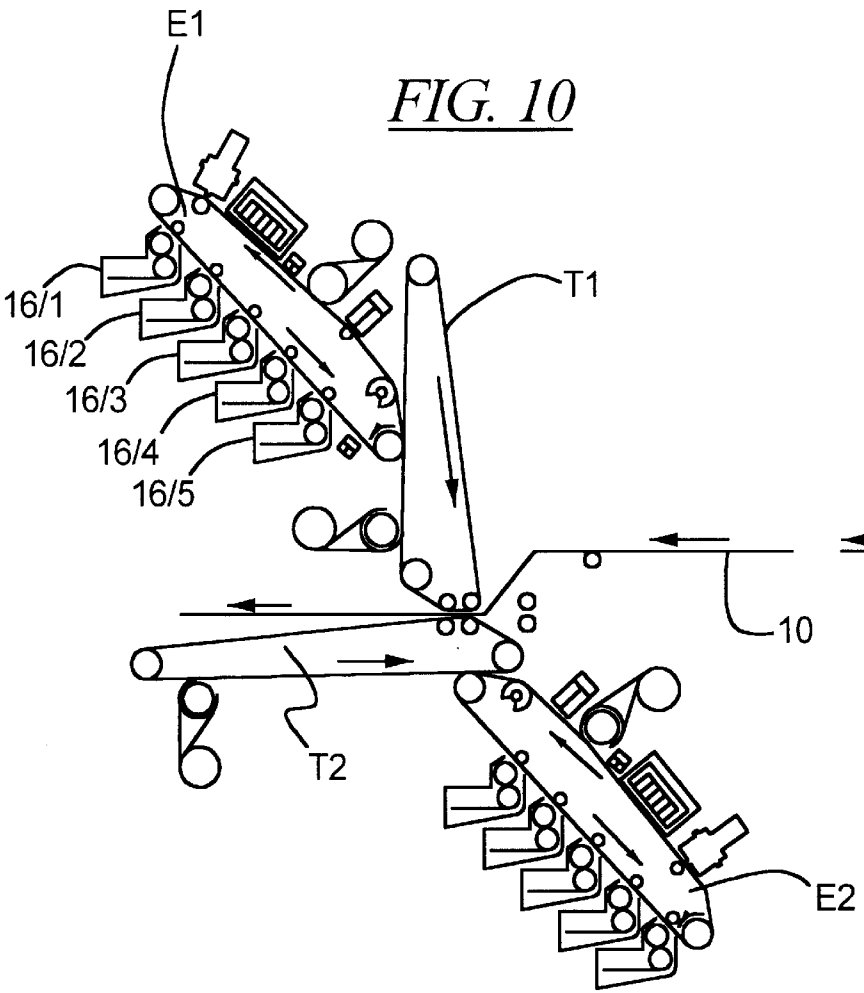

In terms of basic structure, the exemplary embodiment shown in FIG. 11 corresponds to the exemplary embodiment of FIG. 1. In order to save space, the transfer modules T1 and T2 were arranged at an angle of nearly 90° relative to one another. The electrophotography modules, which are analogous to the embodiment according to FIG. 1 are installed at an angle of approximately 45° relative to the perpendicular.

The angle of 45° is generally advantageous because, due to the slant, all developer stations 16/1 through 16/5 can be installed above one another or, respectively, next to one another.

The embodiment according to FIG. 11, which basically likewise corresponds to FIG. 1, exhibits transfer modules T1 and T2 that are arranged at an obtuse angle relative to one another. The transfer modules are fanned open in the transfer region between transfer modules and electrophotography modules, so that a broader seating surface for the transfer band 19 at the photoconductor band 13 derives.

Figure 12:
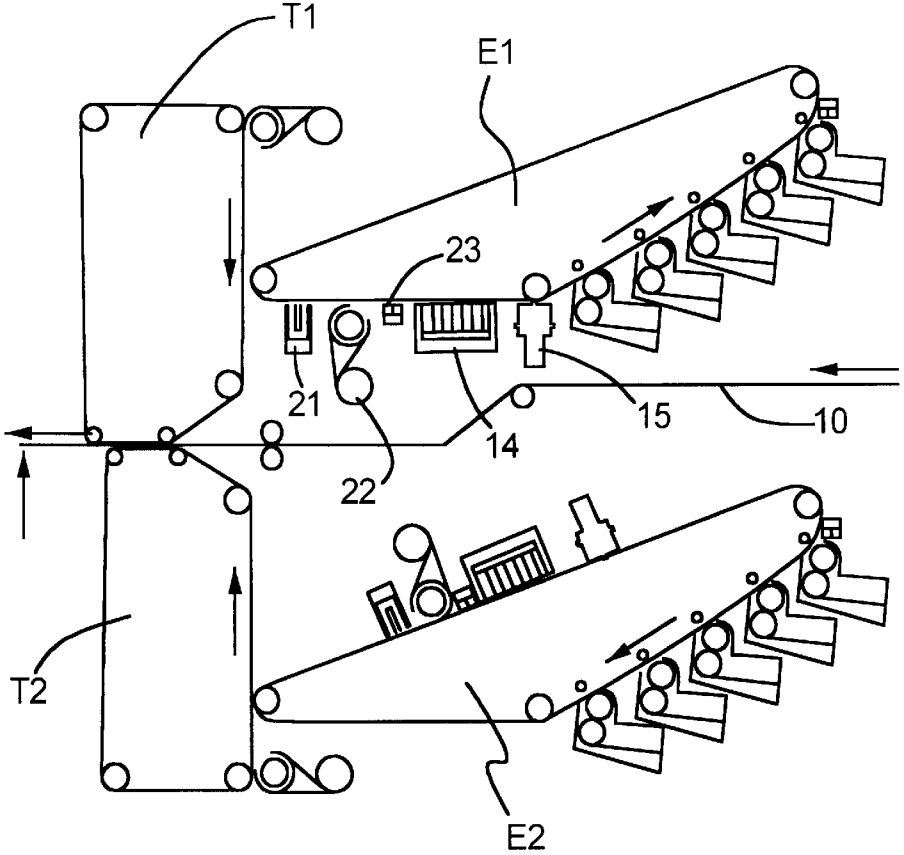

In conformity with the illustration of FIG. 12, it is also possible to arrange the transfer modules T1 and T2 opposite one another in a vertical installed position. The electrophotography modules E1 and E2 can be fashioned proceeding horizontally in the region of the image-generating means with a character generator 15, a charging means 14, an intermediate exposure means 23, a cleaning station 22 and a discharge means 21. The transfer band 19 thus proceeds on a straight line in this region, this facilitating the image generation and the arrangement of the units.

Figure 13:
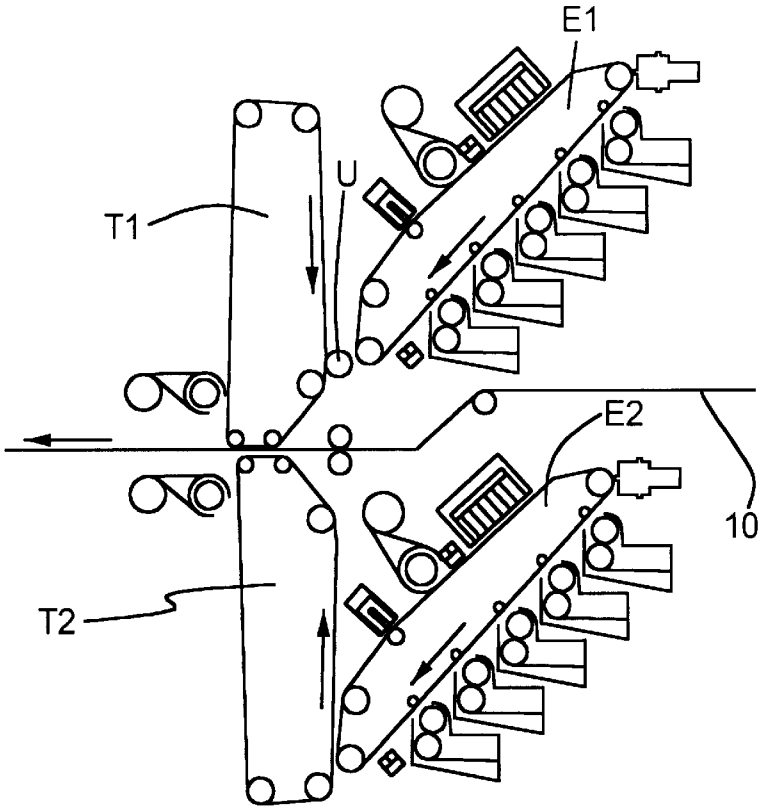

As can be seen from the embodiment corresponding to FIG. 13, it is also possible to arrange an additional transfer printing roller U between the transfer band modules T1 or, respectively, T2 and the electrophotography modules. Electrophotography module E1, E2 and transfer module T1, T2 can thus be exactly matched to one another, and the advantages of the transfer technology also take effect in the region between the electrophotography module and the transfer module.

Figure 14:
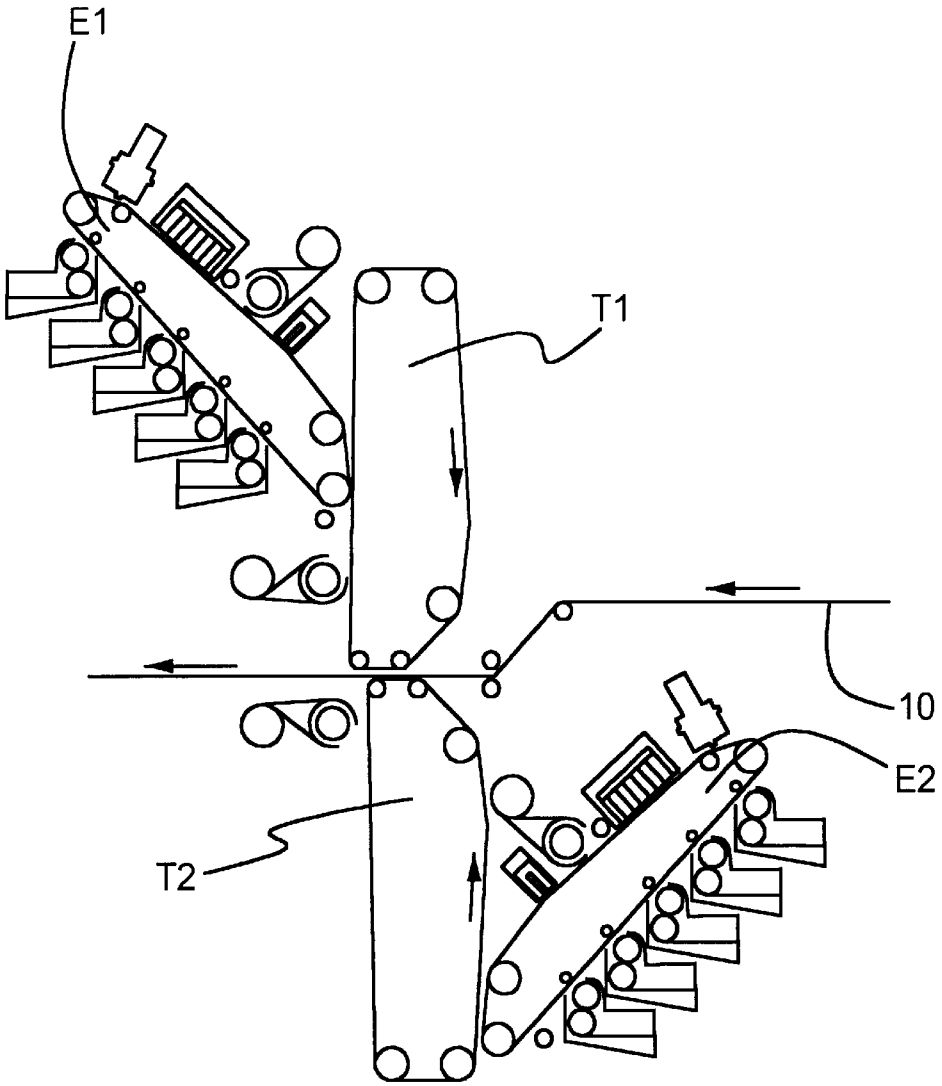

The embodiment according to FIG. 14 is a modification in the embodiment of FIG. 12 or, respectively, FIG. 13 with a corresponding arrangement of the transfer module T1, T2 and the electrophotography module E1, E2.

The device has been described up to now with reference to operation with continuous form paper. According to the versions of FIGS. 15 through 18, however, it can also be designed for operation with single sheets. To this end, the transport channel 11 corresponding to the embodiment of FIG. 15 contains a plurality of conveying rollers 42 for single sheets. The delivery module M1 comprises three reservoirs 43, 44 and 45 for single sheets. Corresponding haul-off devices 46 are coupled to the reservoirs 43, 44 and 45. These haul-off devices 46 are in turn in communication with the transport channel 11. Controlled by the control means ST, the haul-off devices 46 are activated when a single sheet is supplied to the transport channel 11. The printing of the single sheets ensues analogous to the way described in conjunction with FIG. 1. The single sheets are thereby supplied either in a start-stop mode or are also continuously printed given a monochrome printing operation. Analogous to the delivery module Ml, the post-processing module M4 contains three collecting receptacles 47, 48 and 49 that are in communication with the transport channel via corresponding channels with allocated guide shunts. A job-by-job deposit of the printed single sheets in the collecting containers 47, 48 and 49 of the post-processing module M4 is thus possible. For example, it is possible to compile corresponding jobs in the collecting containers 47, 48 and 49, namely dependent on the charging via the reservoir of the delivery module M1. Thus, the reservoirs 43, 44 and 45 of the delivery module M1 can, for example, contain different types of paper of different size and quality. These papers can then be correspondingly printed and deposited in the collecting containers of the post-processing module M4.

Figure 15:
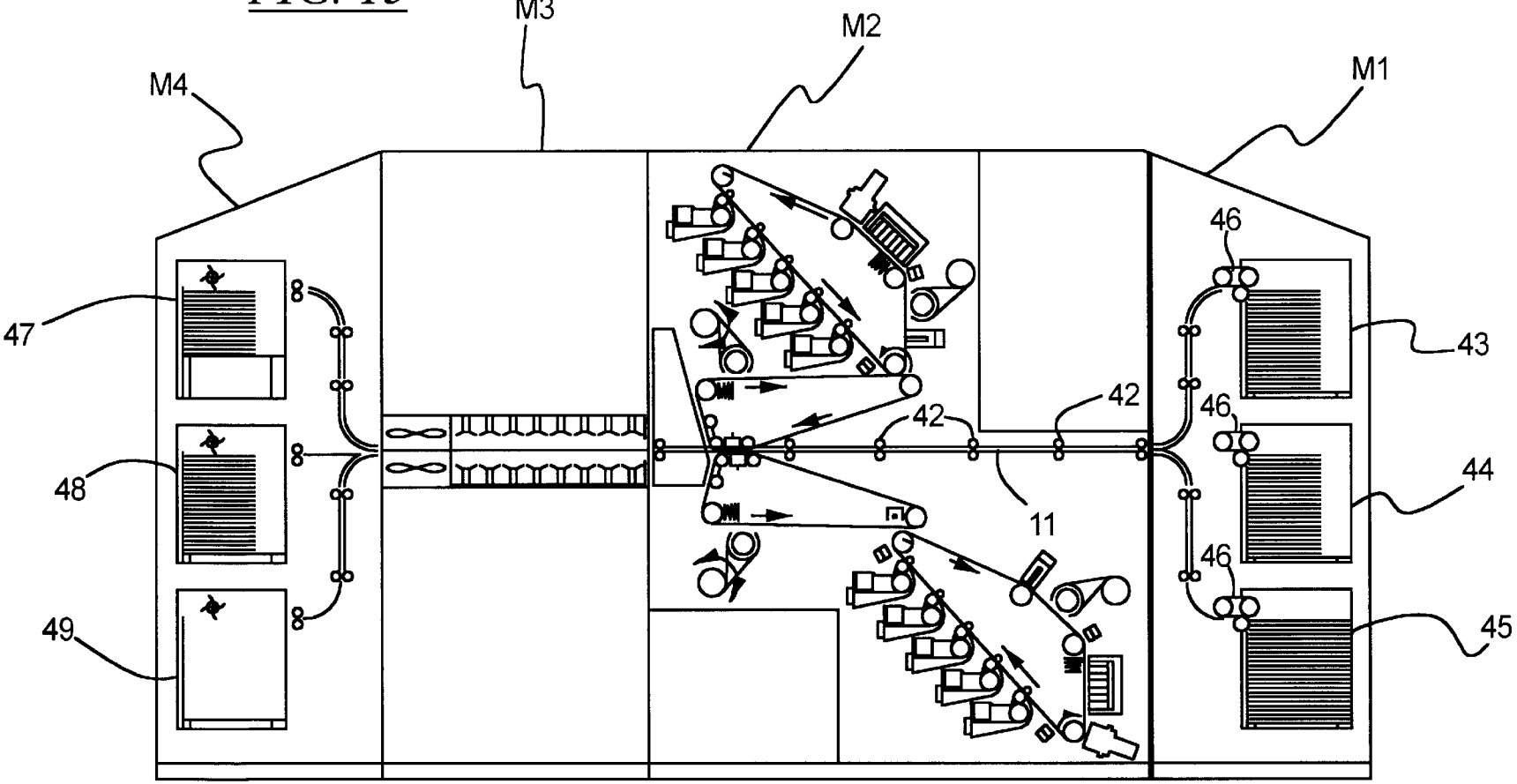
FIGS. 15 through 18 are different embodiments of printer devices that are suitable for operation with single sheets.
Figure 16:
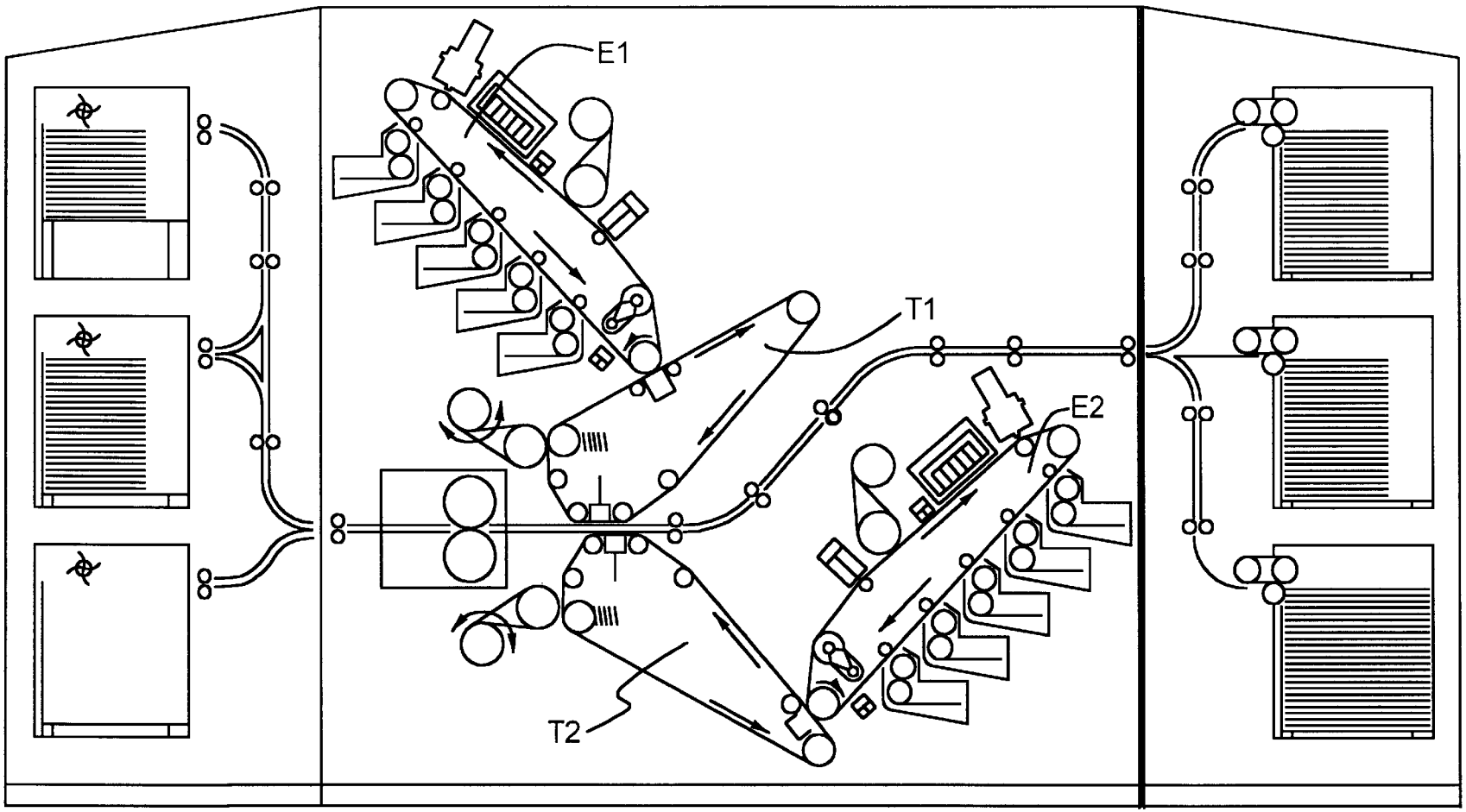

The exemplary embodiment of FIG. 16, which is suitable for single sheets, corresponds in terms of its basic structure to the exemplary embodiment of FIG. 15, with the difference that, analogous to the exemplary embodiment of FIG. 5, the electrophotography modules E1 and E2 are installed perpendicularly relative to one another in a space-saving fashion.

Figure 17:
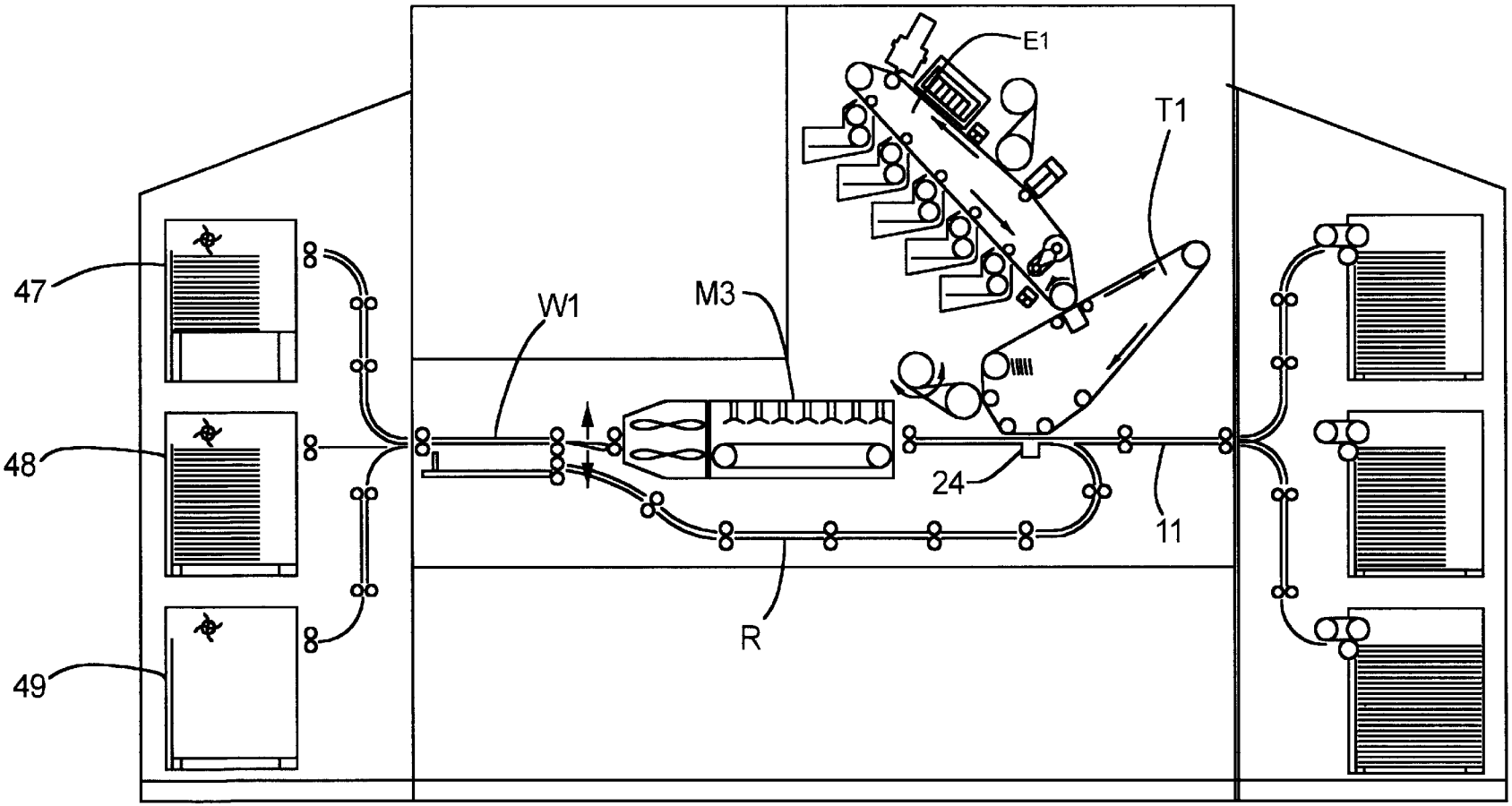

As regards the exemplary embodiment of FIG. 17, its fundamental structure corresponds to the exemplary embodiment of FIG. 2, i.e. only one electrophotography module E1 with a transfer module T1 is arranged at one side of the transport channel 11. Given operation with continuous form paper, it would thus only be suitable for the simplex mode. The exemplary embodiment of FIG. 17, however, contains a turn-over means W1 following the fixing module M3 in the paper conveying direction, this turn-over means being constructed in a way known from single sheet technology. A return channel R is connected to the turn-over means W1, this return channel R discharging into the actual transport channel 11 preceding the transfer printing station 24 of the transfer module T1 as viewed in conveying direction of the paper. It is thus possible to print single sheets on both sides, even though the device comprises an electrophotography module E1 and a transfer module T1 at only one side. After a collective toner image has been initially applied on a single sheet on the front side, this collective toner image is fixed in the fixing module M3. Subsequently, the single sheet which is fixed in this way is reversed in terms of its moving direction in the turn-over station W1 and is resupplied to the transfer printing station 24 via the return channel in a turned-over form for the acceptance of a backside toner image. After fixing the backside toner image, the turn-over station W1 is deactivated and the duplex-printed single sheet is deposited in one of the collecting containers 47, 48 or 49. With the means shown in FIG. 17, it is possible to print, for example, in a simplex mode which is performed adapted and to activate a duplex printing mode as needed by a turn-over of the paper.

Figure 18:
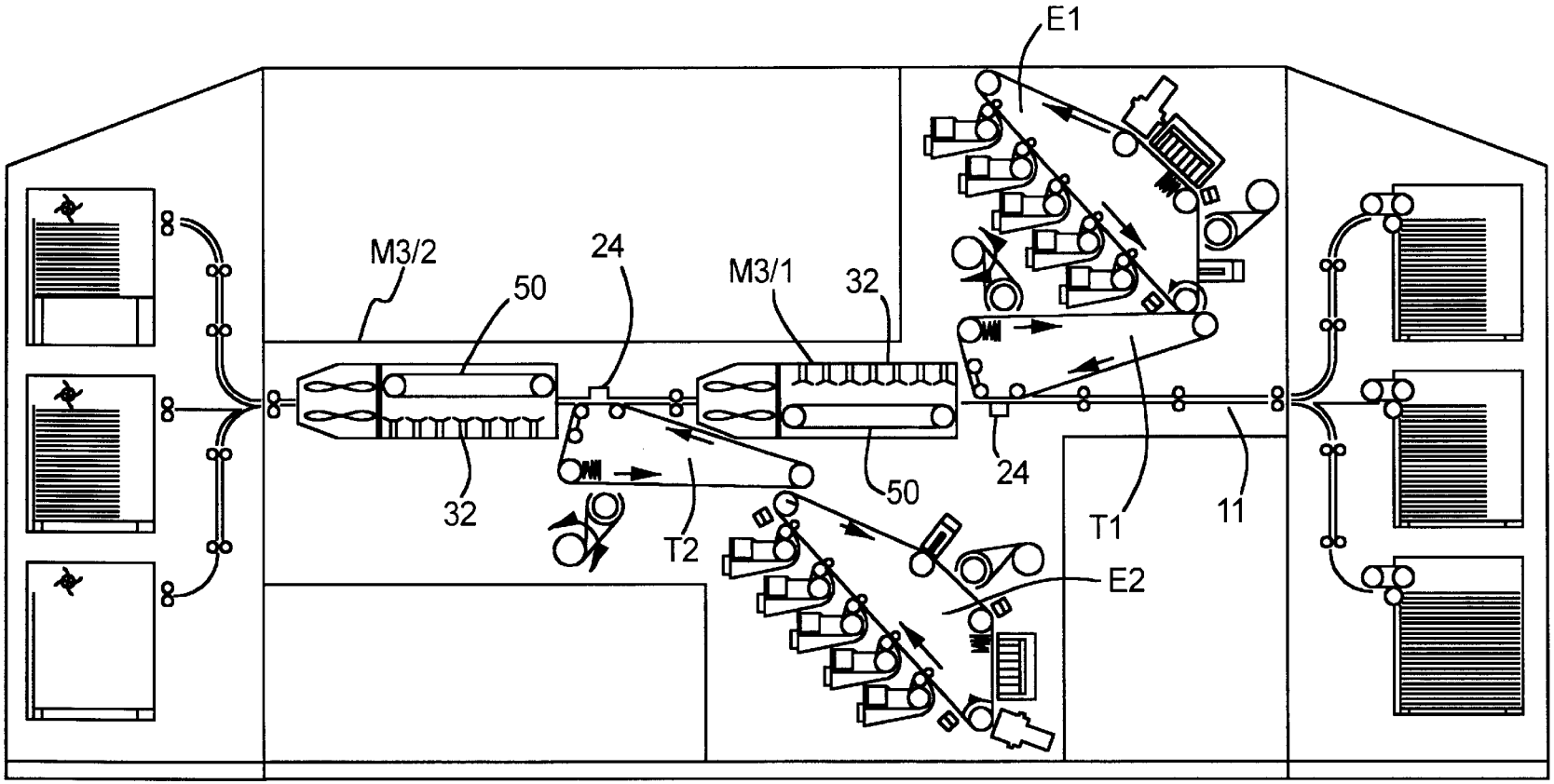

In conformity with the illustration of FIG. 18, it can be beneficial to pull the opposite positions of the transfer modules T1 and T2 away from one another. For example, it has been found that the transfer modules T1 and T2 that are lying opposite one another mutually influence one another in the region of their transfer printing stations 24, this requiring special shielding measures. When the transfer modules T1 and T2 are locationally separated according to the illustration of FIG. 18, then no special shielding and no particular decoupling are required. It is also possible to arrange an additional fixing module M3/1, which functions as an intermediate fixing module, between the transfer printing stations 24 of the transfer modules T1 and T2. It is thus not necessary to transport the sheet-shaped recording medium in a non-contacting fashion in the region of the fixing module M3/1. For example, it can have its side that has not yet been printed lying on a conveyor belt 50, and can be conveyed along infrared radiators 32 with the assistance of this conveyor belt. After applying the backside toner image, the backside toner image is fixed with the backside fixing means M3/2 in an analogous fashion. Here, too, the single sheet is transported in the region of the side that has already been fixed, namely with the conveyor belt 50, and the fixing of the loose toner image of the backside ensues via the infrared radiators 32. The function of the device corresponds to the embodiment of FIG. 15.

Figure 19:
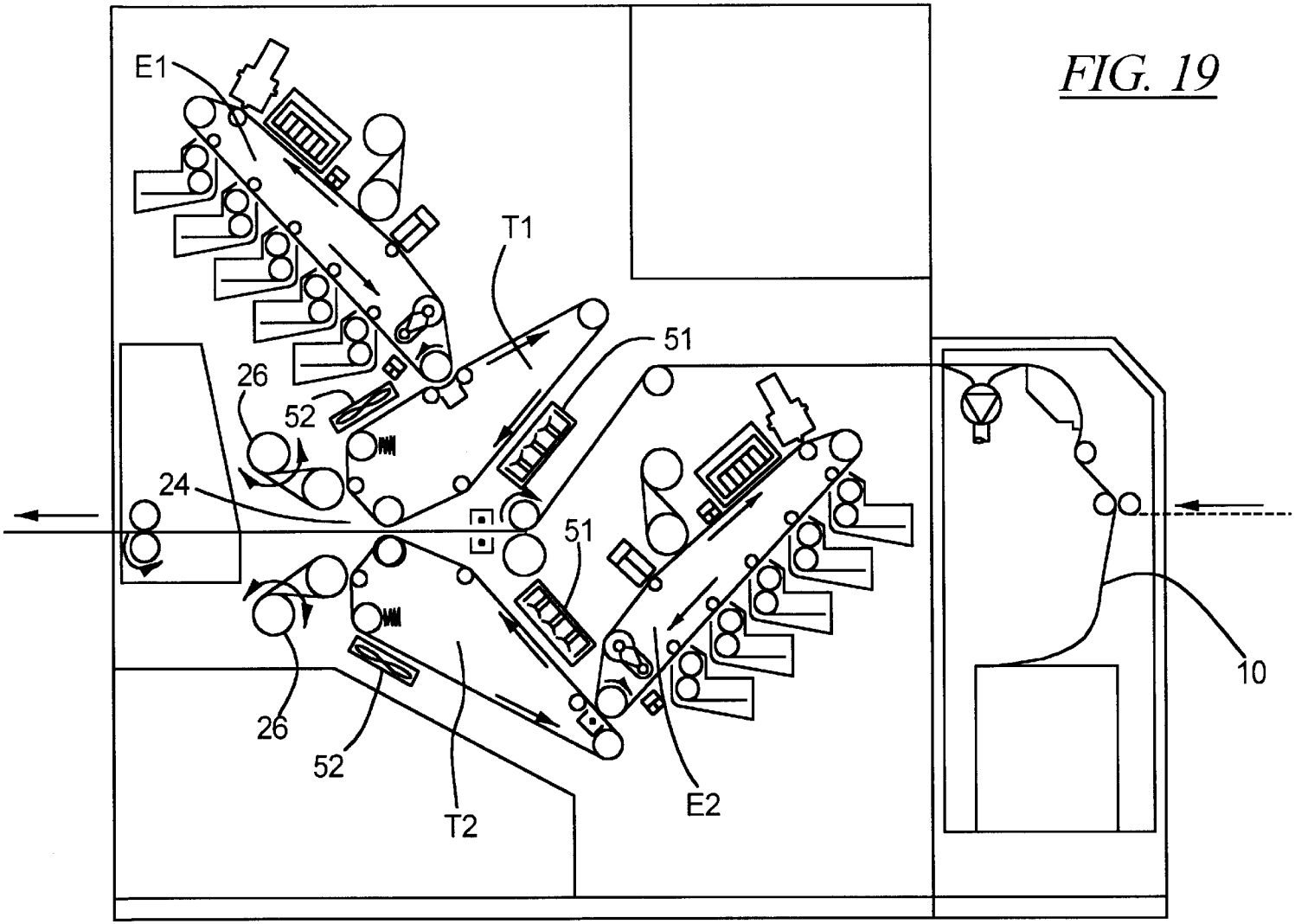
FIG. 19 is a schematic sectional view of a printer device corresponding to FIG. 5 with transfer modules that contain heatable transfer bands.

Given the exemplary embodiments described up to now, what are referred to as cold transfer bands are employed as the transfer bands 19 in the region of the transfer modules T1 and T2. This means that the transport or, respectively, the transfer of the toner images onto the transfer band ensues on the basis of electrostatic forces of adhesion. After the transfer printing of the loose toner images onto the recording medium 10, a hot fixing is then needed in the described way. When, corresponding to the illustration of FIG. 19, what are referred to as warm transfer bands are employed instead of the cold transfer bands, it is possible to transfer the collective toner image onto the recording medium 10 in the region of the transfer printing station 24 and to fit it simultaneously with the transfer event. To this end, a heating means 51 is allocated to each of the transfer bands 19 in the region of the transfer modules T1 and T2, this heating means 51 heating the transfer band 19 with the collective toner image located thereon, namely into the boundary region in which the toner image becomes sticky. The transfer band 19 is subsequently rolled on the recording medium 10 with the warm toner image. The toner image fuses with the surface of the recording medium 10. Toner residues are removed via a cleaning means 26, as described. A cooling device 52, for example in the form of a blower, is arranged following the cleaning station 26 as viewed in the conveying direction of the transfer band 19, this serving the purpose of cooling the transfer band 19. After this, it is again in the transfer condition wherein toner images can be transferred from the photoconductor band 13 onto the transfer band 19. The printer device described in FIG. 19 can be operated in all operating conditions analogous to the printer device of FIG. 1. The fixing, however, ensues immediately after the transfer printing process. When the fixing is inadequate, it is also possible to additionally arrange a fixing module at the output side at the paper guidance channel 10.

The invention has been described above with reference to a high-performance printer means. However, it is also possible to fashion the device as a copier means. In this case, the original to be copied is scanned in the standard way and the scan signals are supplied directly to the character generator 15. Further, transfer bands 19 were employed in the transfer modules T1 and T2. However, it can also be imagined that transfer drums be employed instead of transfer bands.

Although other modifications and changes may be suggested by those skilled in the art, it is the intention of the inventors to embody within the patent warranted hereon all changes and modifications as reasonably and properly come within the scope of their contribution to the art.

What is claimed is:

1. A printer or copier device for performance-adapted, monochrome and/or chromatic single-sided or both-sided printing of a recording medium, comprising:

at least one electrophotography module for generating toner images, said at least one electrophotography module including:

a continuous photoconductor on which the toner images are generated, a plurality of developer stations arranged along a surface of the continuous photoconductor and individually switchable to generate the toner images on said continuous photoconductor, said developer stations each being respectively allocated to a single color separation toner image;

at least one transfer module including:

an endless transfer band that has a transfer accepting region for accepting toner images from the at least one electrophotography module and a controllable transfer printing region for transfer printing of toner images onto the recording medium, wherein in a transfer printing condition of the at least one transfer module the endless transfer band contacts the recording medium and in a collecting condition of the at least one transfer module the endless transfer band is distanced from the recording medium;

a transport channel including:

controllable transport for the recording medium, the recording medium being a continuous web-shaped recording medium, said at least one electrophotography module and said at least one transfer module being arranged at at least one side of the transport channel;

a controller coupled to the at least one electrophotography module and to the at least one transfer module and to the controllable transport that controls the at least one electrophotography module and the at least one transfer module and the controllable transport such that printing is a performed in two printing modes, said two modes being a start/stop mode and a continuous mode wherein, for printing a recording medium moved through the transfer printing region in the start-stop mode in a first operating condition of the apparatus, the color separation toner images in the collecting condition of the transfer module are serially transferred from the electrophotography module onto the transfer band and an exactly registered collective image is produced on the transfer band, said collective image then being transferred in the transfer printing region of the transfer module onto the recording medium, and, for printing a recording medium moved continuously through the transfer printing region in the continuous mode of the apparatus of the transfer module, the toner images are directly transferred from the at least one electrophotography module onto the endless transfer band and are transferred onto the recording medium without collecting.

2. A printer or copier device according to claim 1, wherein said at least one electrophotography module includes at least one electrophotography module allocated to a front side of the recording medium with a first appertaining transfer module and at least one electrophotography module allocated to a back side of the recording medium with a second appertaining transfer module, said first and second transfer modules being arranged at both sides of the transport channel.

3. A printer or copier device according to claim 2, wherein said first and second transfer modules are arranged lying opposite one another in the transfer printing region.

4. A printer or copier device according to claim 2, wherein said first and second transfer modules have their transfer printing regions arranged offset relative to one another along the transport channel.

5. A printer or copier device according to claim 4, further comprising; a fixing module with thermal fixing following every transfer printing region of the first and second transfer modules arranged offset relative to one another as viewed in a conveying direction of the recording medium.

6. A printer or copier device according to claim 1, further comprising:

at least one fixing module following the transfer printing region in a conveying direction of the recording medium and having a thermal fixing apparatus arranged therein.

7. A printer or copier device according to claim 6, wherein the thermal fixing apparatus is an infrared fixing apparatus that works in a non-contacting fashion.

8. A printer or copier device according to claim 6, wherein said thermal fixing apparatus includes a conveyor belt that accepts the recording medium with its side that has not yet been tonered or on which toner is already fixed, and an infrared apparatus lying opposite the conveyor belt for fixing the loose toner images.

9. A printer or copier device according to claim 6, further comprising:

a post-processing module following the at least one fixing module and having a separating apparatus arranged therein.

10. A printer or copier device according to claim 1, wherein said controllable transport includes motor-driven conveyor rollers for the recording medium.

11. A printer or copier device according to claim 1, further comprising: a delivery module for the recording medium having a web storing apparatus which is a loop-forming apparatus.

12. A printer or copier device according to claim 1, wherein the developer stations are individually replaceable.

13. A printer or copier device according to claim 1, wherein said at least one electrophotography module includes a plurality of image-generating devices with a character generator and at least one developer station.

14. A printer or copier device according to claim 1, wherein said endless transfer band is a cold transfer band, whereby transfer of the toner images ensues on the basis of electrostatic forces.

15. A printer or copier device according to claim 1, wherein said endless transfer band is a heat transfer band and further comprising: an appertaining heating apparatus such that the toner image is simultaneously transfer printed and fixed in the transfer printing region between said endless transfer band and the recording medium.

16. A printer or copier device according to claim 1, wherein said electrophotography module and said transfer module are arranged at only one side of the transport channel, and further comprising:

a turn-over apparatus with appertaining return channel arranged downstream of the fixing module, said turn-over apparatus discharging into the transport channel upstream of the transfer printing region.

17. A printer or copier device according to claim 1, wherein said developer stations are fluidizing developer stations.

18. A printer or copier device according to claim 1, wherein said developer stations are arranged along a path of the photoconductor proceeding in an angular range of 35° through 50° relative to the perpendicular.

19. A method for performance-adapted monochrome and/or chromatic, single-sided or both-sided printing of a recording medium with a printer or copier device, whereby the device comprises:

a) at least one electrophotography module for generating toner images on a continuous photoconductor with the assistance of a plurality of developer stations arranged along the surface of the photoconductor and individually switchable that are respectively allocated to a single color separation toner image;

b) at least one transfer module with an endless transfer band that comprise a transfer region for accepting toner images from the electrophotography module and a controllable transfer printing region for the transfer printing of toner images onto the recording medium, whereby, in a transfer printing condition of the transfer module, the transfer band contacts the recording medium and, in a collecting condition of the transfer module, the transfer band is distanced from the recording medium;

c) a transport channel comprising a controllable transport for the recording medium and having electrophotography and transfer module arranged at one side or both sides of the transport channel;

comprising the following steps:

printing a continuous web-shaped recording medium moved through the transfer printing region in start-stop mode in a first operating condition of the apparatus by serial transfer from the electrophotography module, superimposed depositing as a collective image on the transfer band, and transfer printing of the collective image onto the recording medium, and printing a recording medium moved continuously through the transfer printing region in a second operating condition of the apparatus by direct transfer of a toner image from the electrophotography module onto the transfer band and from the transfer band onto the recording medium without collecting.

* * * * *